United States Patent [19]

Kocourek et al.

[11] Patent Number: 4,958,666

[45] Date of Patent: Sep. 25, 1990

[54] STORAGE CANISTER FOR PROCESS LIQUIDS FOR USE IN AN APPARATUS FOR WET PROCESSING OF PHOTOGRAPHIC MATERIAL

[75] Inventors: Franz Kocourek; Hans Ketterer; Alfons Kastl; Rudolf Loistl, all of Munich, Fed. Rep. of Germany

[73] Assignee: Agfa-Gevaert Aktiengesellschaft, Leverkusen, Fed. Rep. of Germany

[21] Appl. No.: 277,003

[22] Filed: Nov. 28, 1988

[30] Foreign Application Priority Data

Dec. 17, 1987 [DE] Fed. Rep. of Germany ..... 3742821

[51] Int. Cl.[5] ..... B65B 3/17

[52] U.S. Cl. ..... 141/114; 141/314; 222/214; 354/324; 220/404

[58] Field of Search ..... 141/313, 314, 315, 114; 220/403, 404; 222/206, 213, 214; 354/324

[56] References Cited

U.S. PATENT DOCUMENTS

| | | | |
|---|---|---|---|
| 3,029,983 | 4/1962 | Wagenhals | 222/94 |
| 3,074,402 | 1/1963 | Broman | 222/94 |
| 3,687,050 | 8/1972 | Wilke | 222/94 |
| 4,018,253 | 4/1977 | Kaufman | 141/314 |
| 4,148,417 | 4/1979 | Simmons | 222/94 |
| 4,413,645 | 11/1983 | Seabase et al. | 137/223 |
| 4,579,141 | 4/1986 | Arff | 137/223 |
| 4,734,728 | 3/1988 | Müller | 354/324 |
| 4,741,461 | 5/1988 | Williamson et al. | 222/214 |
| 4,791,013 | 12/1988 | Koboshi et al. | 222/94 |

*Primary Examiner*—Henry J. Recla
*Assistant Examiner*—Edward C. Donovan
*Attorney, Agent, or Firm*—Michael J. Striker

[57] ABSTRACT

A storage canister for process liquid includes a receptacle having a top side formed with two apertures. The receptacle houses two leakage proof pouches of elastic material each having an opening closed by a control valve. An upper part of respective valve housing projects through the aperture and is secured thereto while the lower part of the valve housing within the corresponding pouch extends up to the bottom of the receptacle. The pouches are arranged one above the other between the top cover and the bottom of the receptacle and being extendable to such an extent that their combined volumes correspond approximately to the volume of the receptacle. Preferably, the receptacle has the form of a flat parallel epiped so that a plurality of equal storage canisters are inserted into a drawer of wet processing apparatus and the normally closed control valves are activated by suction or by over-pressure from suction or pressure devices in the processing apparatus.

9 Claims, 4 Drawing Sheets

STORAGE CANISTER FOR PROCESS LIQUIDS FOR USE IN AN APPARATUS FOR WET PROCESSING OF PHOTOGRAPHIC MATERIAL

BACKGROUND OF THE INVENTION

The invention relates to a storage canister for process liquids such as solutions for processing photographic material. The canister is used preferably in a wet processing apparatus in such a manner that a plurality of storage canisters of the same type is inserted into a drawer of the wet processing apparatus and are connected via at least one control valve to a suction or pumping device of the wet processing apparatus.

In German Patent No. 36 09 526 assigned to the same assignee and corresponding to U.S. Pat. No. 4,734,728 the entire disclosure of which is incorporated herein by reference, a wet processing apparatus is disclosed in which a storage container of the aforementioned type is inserted into a storage drawer of the apparatus and, at the same time, is connected to the suction or pumping devices. In this known embodiment it is necessary that either a waste water container is provided into which the entire amount of used up photographic bath is drained; alternatively, there are provided two canisters for each bath, namely a supply canister for the fresh bath and another canister for draining the used up liquid. At the beginning of the treatment the supply canister is full and the draining canister for the consumed liquid is empty whereas at the end of the processing operation the supply canister is empty and the draining canister is filled up. Consequently, it is necessary in the prior art device to maintain an unexploited space in the storage drawer of the apparatus for the empty or partially empty canisters.

SUMMARY OF THE INVENTION

It is therefore a general object of the present invention to overcome the disadvantages of the prior art storage canisters.

More particularly, it is an object of the invention to provide an improved storage canister of this kind in which the changing volume of the fresh or used up process liquid are combined in such a manner that no unexploited empty space takes place in the canister.

In keeping with this object and others which will become apparent hereafter, one feature of this invention resides in the provision of a receptacle having a top cover provided with two apertures, two pouches made of an elastic leakage proof material and being arranged one above the other in the receptacle, each pouch having an upwardly directed neck part provided with a control valve which is secured in the assigned aperture of the top cover and projects to the bottom of the receptable, one of the pouches being extendable while the other being collapsible to such an extent that their combined volumes occupy substantially the entire volume of the receptacle. The housing of each control valve has a tubular low portion extending close to the bottom of the pouch and communicating with the interior of the pouch by an inlet or outlet opening provided at the end of the tubular housing portion. In the preferred embodiment, the receptacle of the canister has the configuration of a flat parallelepiped and the two pouches extending one above the other between the major upper and lower sides of the receptacle. The control valves extend parallel to a narrow side of the receptacle and are mounted side-by-side in the apertures of the broad upper side. The end portion of each pouch which is provided with the control valve converges toward the narrow side of the receptacle and the converging end portions of respective pouches cross one another. In a modification mounting apertures for the control valves are provided at the ends of diagonals of the cover of the receptacle and the downwardly directed housing parts of respective valves together with the end parts of converging end portions occupy corner areas at the narrow side of the receptacle. The control valves are normally closed whereby one control valve is opened by suction developed by a suction pump and the other control valve is opened by pressure developed by a delivery pump of a known processing apparatus.

In the preferred embodiment, the receptacle of the canister is assembled of two pieces, namely of a U-shaped bottom part forming a broad bottom side and two narrow lateral side, and of a U-shaped cover part forming the broad top side and two narrow front sides. The top cover part is inserted together with the valves and two pouches into lateral guiding grooves on the bottom part. The rim portion of the opening of each pouch is hermetically sealed between the clamping ring provided with a sealing 0-ring, and a flange formed by the outer part of the valve housing or the upper surface of the top cover. The flange is provided with a thread engaging a safety nut. In a modification, the rim portion of the pouch opening is clamped between two flanges of the valve housing held together by means of a screw connection. In still another modification the rim part of the opening of each pouch is secured to a threaded collar which passes through the corresponding aperture in the top cover and being secured thereto by a nut.

By virtue of the arrangement according to this invention, namely of two separate liquid-tight elastic pouches lying one above the other in a receptable it is made possible to exploit the entire volume of the receptable.

When discharging process liquid from one pouch and feeding in the other pouch the used up liquid, the volume ratio of individual pouches varies but the combined volume thereof remains approximately constant. At the same time, the receptable or canister need not be leakage proof and can be of a simple construction which enables an easy replacement of the two pouches. Due to the elimination of a separate canister or receptable for the used up liquid, the weight reduction in comparison to prior art solutions is achieved. Moreover, the the problems related to the build up and release of air pressure in the containers being discharged and filled are automatically solved by the corresponding changes in volumes of the two pouches.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figures 1, 2:
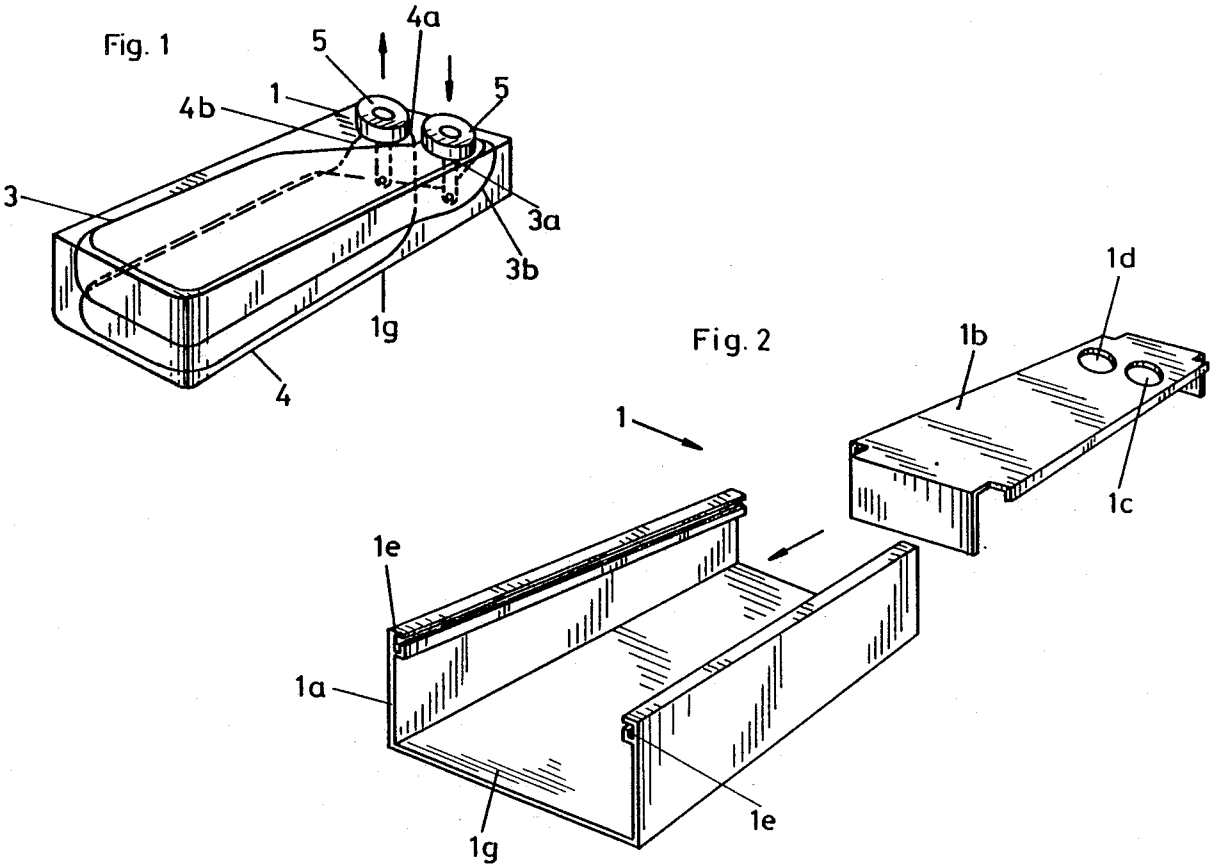
FIG. 1 is a receptacle or schematic perspective view of a canister of this invention shown with the pouches for the fresh and used up process liquid.
FIG. 2 is a perspective view of a disassembled two piece receptacle or canister of FIG. 1.
Figure 3:
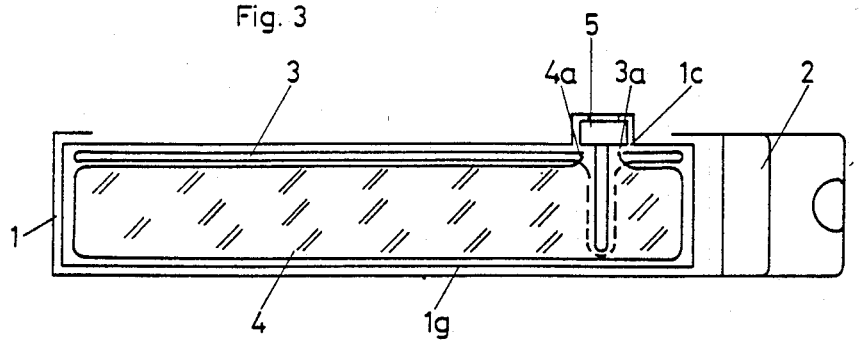
FIGS. 3–6 show in a sectional side view the receptacle or canister of FIG. 1 at different filling conditions of the two pouches.
Figure 4:
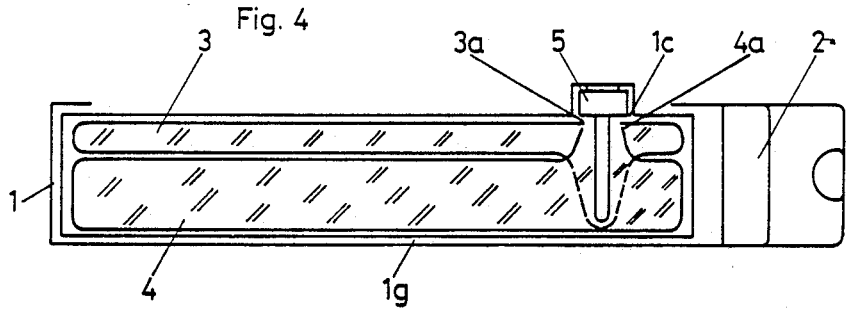
Figure 5:
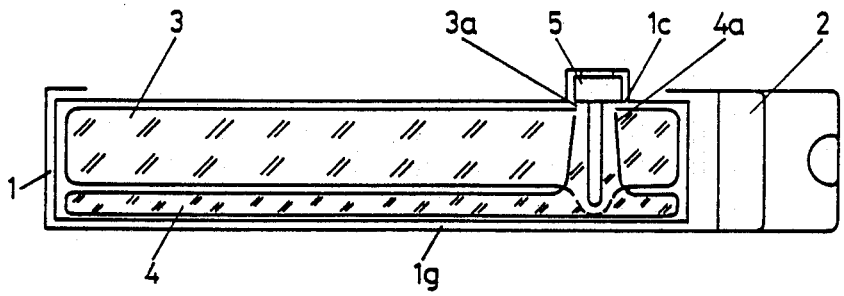
Figure 6:
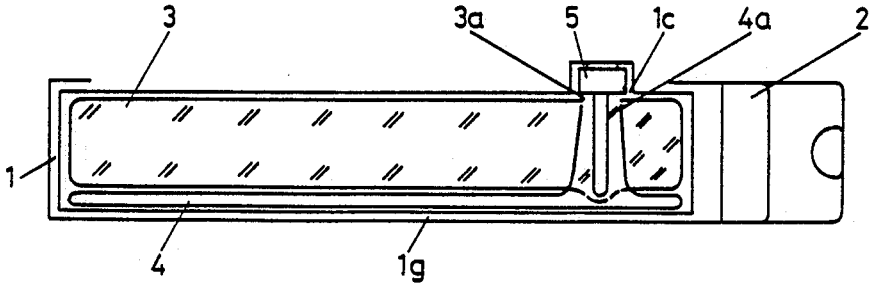
Figure 7:
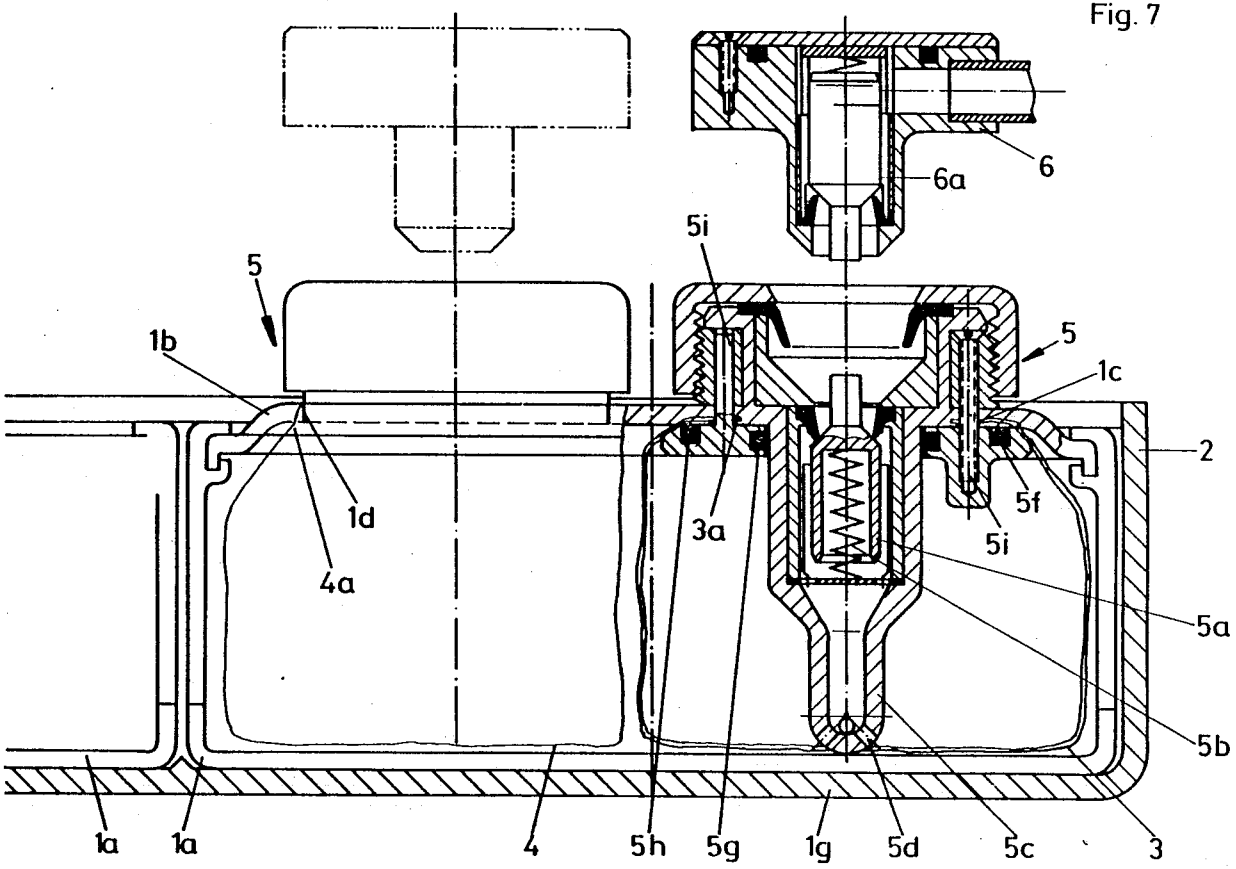
FIG. 7 shows in a sectional side view of a portion of the receptacle canister of FIG. 1 showing on an enlarged scale, an embodiment of a control valve of a pouch.

The present invention is based on a canister or receptacle 1 for storing process liquids for photographic materials, preferably for use in an apparatus for processing X-ray sheet films according to the U.S. Pat. No. 4,734,728. The canister is insertable together with other canisters of the same configuration into a drawer 2 (FIGS. 3 through 7) slidable into the prior art sheet film processing apparatus. The canisters can be also directly insertable into corresponding recesses or compartments of the processing apparatus for the photographic material. The canister 1 is in the form of a flat parallelepiped as illustrated in FIG. 1. In order to fully exploit the volume of the canister 1 without a necessity to provide side-by-side a filled up supply container and an empty waste liquid container or two partially filled containers, particularly when used in the drawers 2 of the processing apparatus, the canister or receptable 1 according to the invention, houses two liquid proof, elastic pouches 3 and 4 each having a converging end portion 3*b*, 4*b* provided with open, upwardly directed neck part 3*a*, 4*a* closed by a control valve 5. The two pouches are arranged in the receptable 1 one above the other in such a manner that their combined volumes occupy substantially the entire volume of the receptable 1, their converging end portions 3*b*, 4*b* cross one another and their neck parts 3*a*, 4*a* extend side by side towards apertures in the top side of the receptacle 1.

Figure 10:
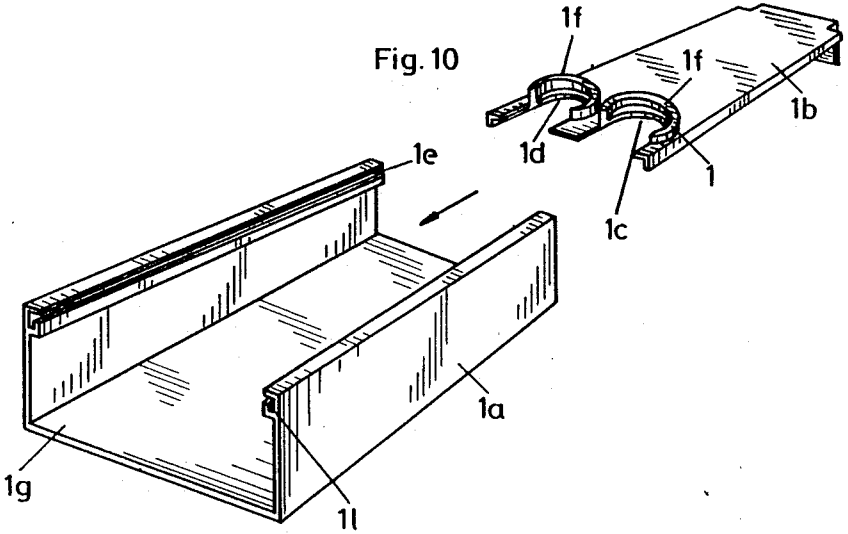
FIG. 10 is a perspective view similar to FIG. 2 of another embodiment of the receptacle or canister for receiving pouches according to FIGS. 8 and 9.

The receptable or storage canister 1 of this invention need not be made leakage proof. In the preferred embodiment shown in FIG. 2, it consists of a bottom part 1*a* and a top part 1*b* whereby each pouch 3 and 4 is held in position by its control valve 5 which is secured in a corresponding aperture 1*c* or 1*d* in the top part 1*b* of the receptacle 1. The top part 1*b* as illustrated in FIGS. 2 and 10 has approximately a U-shaped profile forming the broad top side and the narrow end sides of the receptacle 1 whereas the bottom part 1*a* has a complementary U-shaped profile forming the broad bottom side and the narrow lateral sides. The lateral edges of the broad bottom sides of the top part 1*b* are inserted into guiding grooves 1*e* formed in the longitudinal edges of the narrow lateral sides of the bottom part 1*a*. If it is desired to instal the two pouches together with their control valves into an assembled receptacle 1, then instead of apertures 1*c*, 1*d* in the top part through which the neck parts 3*a*, 4*a* of the pouches must be inserted from below, then according to FIG. 10 the apertures 1*c*, 1*d* are in the form of recesses opening in a narrow end side of the top cover whereby the semi-circular parts of respective apertures are provided with supporting collars 1*f*. In the latter case the neck parts 3*a*, 4*a* of the pouches are inserted into the mounting apertures from the open end side of the assembled receptacle 1. However, still other modifications of the mounting of the pouches are possible. For example, the bottom part 1*a* can be made in the form of an open box onto which a cover part 1*b* together with pouches 3 and 4 is applied from above on the bottom part.

If the receptacle 1 is shaped in the form of a flat parallelepiped then it is of advantage that the pouches 3 and 4 have also a flat configuration and are arranged one above the other between the major sides of the flat parallelpiped. The elastic pouches are extendable to such an extent that their combined volumes correspond approximately to the volume of the receptacle. Accordingly, if one of the pouches is fully filled up, it occupies approximately the volume of the receptacle, whereas the other pouch is empty and compressed against the inner surface of a major side of the receptacle. Inasmuch as the pouches 3 and 4 in the area of their 3*a*, 4*a* cannot overlap with one another because their control valves 5 pass through the assigned apertures 1*c* and 1*d* in the receptacle 1 and extend in the interior of respective pouches as far as to the bottom 1*g* of the receptacle in order to enable the suction of a liquid from the bottom region of the corresponding pouch, the end portions 3*b* and 4*b* of the pouches in the area of respective control valves 5 converge to form a bottleneck like projection. In the installed condition, the converging bottleneck shaped portions of the superimposed pouches 3 and 4 cross one another and their ends in the region of apertures 1*c* and 1*d* occupy the canister or adjacent corner areas of the receptacle 1. In the embodiments of the invention where the apertures 1*c* and 1*d* are provided at diagonally opposite corner areas of the top cover of the receptacle, the regions of respective pouches around the control valves may have tubular configuration filling up the corresponding corner area of the receptacle.

It is advantageous when the control valves 5 are in the form of pressure actuated valves wherein any hand operated closure parts are eliminated and consequently the risk of spilling of the liquid is avoided. For example, control valves 5 can be pressure valves of any known kind including a valve piston 5*a* biased by a spring 5*b* upwards into a closing position (FIG. 7); by means of a removable counteracting valve 6 having a spring biased valve piston 6*a* communicating via a connection piece 6*b* with a pressure source at a non-illustrated processing apparatus, the valve piston 5*a* is compressible downwards into its open position. The valve housing 5*c* projects downwardly within the pouch 3 up to the bottom 1*a* of the receptacle and is provided at its lowermost region with suction or discharge openings 5*d*. In the region of the top cover 1*b* surrounding the apertures 1*c* and 1*d*, there are provided stepped collars. The stepped region of each collar is surrounded by a threaded clamping piece 5*e* over which a covering nut 5m is screwed. According to FIG. 7, the rim of each pouch opening 3*a* or 4*a* is clamped between a clamping ring 5*f* engaging an inner side of the pouch and having sealing rings 5*g* and 5*h*, and a step of the valve housing 5*c* and an inner side of the top part 1*b*. The clamping arrangement is held together by a plurality of screws 5*i* to insure a leakage proof seal. Instead of screw connections it is also possible to permanently connect the clamping parts by glueing or welding.

Figure 9:
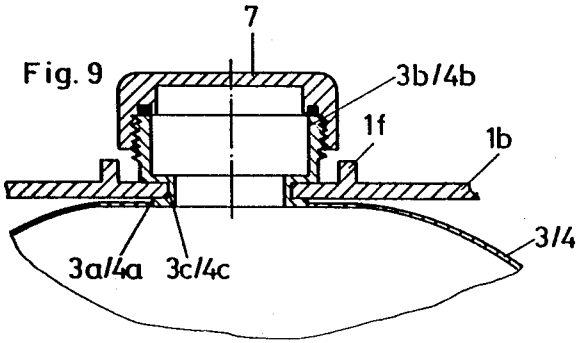
FIGS. 8 and 9 show in sectional view another embodiment of a connection piece for control valve or a closure lid for a pouch.
Figure 8:
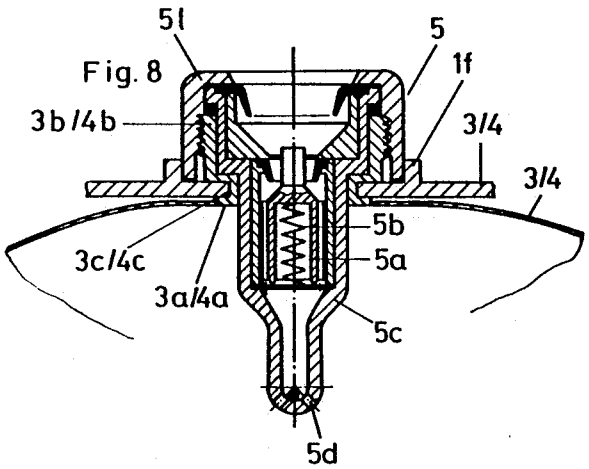

FIGS. 8 and 9 illustrate another embodiment of the closure of respective pouches 3 and 4 by the control valves passing through the apertures 1*c* and 1*d* in the receptacle. In this embodiment the rim of the pouch opening 3a or 4a is shaped in the form of a threaded collar 3b or 3c provided with an outer peripheral groove 3c or 4c. The threaded collar 3b or 4b is of the same material as that of the pouch and is only increased in thickness. The threaded collar can be either welded to the rim portion of the pouch opening or if desired can be shaped together with the pouch. The peripheral groove 3c or 4c of the threaded collar 3b or 4b is brought into engagement with rim portion of the corresponding aperture 1c or 1d in the top side 1b of the receptacle. According to FIG. 8, the valve piece 5 is simply inserted into the pouch 3 or 4 through the corresponding threaded collar 3b or 4b and is secured in position by means of lock nut 5e engaging the outer thread of the collar and resting on the outer surface of the collar 1b of the receptacle. This modified embodiment has the advantage that according to FIG. 9 in the case of a pouch filled up with the used up liquid or an empty supply pouch containing only a residual fresh liquid, it is possible to remove the expensive control valve 5 and close instead the pouch opening by threaded lip 7 in order to remove the pouch for draining in a suitable manner the waste liquid or replenish the fresh liquid.

While the invention has been illustrated and described as embodied in specific examples of the storage canister, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for storing process liquids such as baths for the wet processing of photographic materials, comprising a flat, rectangular receptacle defining two opposite broad sides each having two opposite narrow edges, one of said broad sides having two apertures arranged side by side near to one of said narrow edges; two pouches of an elastic, leakage proof material arranged one above the other in said receptacle, one of said pouches being expandable while the other pouch being collapsible to such an extent that their combined volumes correspond approximately to the volume of said receptacle; each of said pouches having a converging end portion terminating at said one narrow edge opposite an assigned aperture; said converging neck portions crossing one another and being formed, respectively, with an open neck part extending toward the assigned aperture and being closed by a control valve passing through the aperture; and said control valves being fastened to said one broad side.

2. A device as defined in claim 1, further including an apparatus for the wet processing of photographic materials comprising a drawer for accommodating a plurality of said storing devices a suction device for fresh process liquid; a pressure pump for a used up liquid;

said control valves of respective storing devices being normally closed, one of said control valves of respective storing devices being connected to said suction device and opening in response to underpressure and the other control valve being connected to said pump and opening in response to overpressure.

3. A device as defined in claim 1, wherein said control valves project into the interior of the assigned pouch approximately to the bottom of said receptacle and inner inlet or outlet openings of the control valve are provided in the proximity of the lowermost portion of the valve.

4. A device as defined in claim 1, wherein said control valves are normally closed pressure valves, one of said pressure valves being opened in response to overpressure to fill up assigned pouch with a used up process liquid, and the other pressure valve being opened in response to suction to discharge fresh process liquid from the assigned pouch.

5. A device as defined in claim 4, wherein each pressure valve includes a removable countervalve for opening the corresponding valve in response to the overpressure or the suction.

6. A device as defined in claim 1, wherein said receptacle is assembled of a U-shaped bottom part defining a broad bottom side and two narrow lateral sides, and sides, the lateral sides of said bottom part being provided with guiding grooves for receiving lateral edges of the broad side of said top part.

7. A device as defined in claim 1, further comprising means for securing leakage proof the rim of the opening of each neck part to a corresponding aperture of the receptacle, said securing means including a clamping ring arranged within each neck and having at least one sealing ring surrounding the assigned neck part and clamping the corresponding rim portion of the neck part opening against an inner side of said receptacle around an aperture thereof, an annular flange resting on the outer surface of said receptacle around each aperture and being secured to said clamping ring, and the outer part of the housing of each control valve being fastened to said flange.

8. A device as defined in claim 7, wherein said flange is provided with an outer thread and said valve housing being fastened to said flange by means of a locking nut engaging said outer thread.

9. A device as defined in claim 7, wherein the rim portion of each neck part opening is connected to a mounting collar provided with a circumferential groove to engage said inner side of the receptacle around an assigned aperture, and the outwardly projecting part of said collar having an outer thread for engaging an inner thread of a closure lid.

* * * * *